United States Patent [19]

Ikeuchi et al.

[11] Patent Number: 4,533,621

[45] Date of Patent: Aug. 6, 1985

[54] PHOTOGRAPHIC ELEMENT WITH IMADAZOLE DYE MORDANT

[75] Inventors: Satoru Ikeuchi; Yoshihiro Inaba; Hiroshi Shimazaki; Tatsuhiko Kobayashi, all of Tokyo, Japan

[73] Assignee: Konishiroku Photo Industry Co., Ltd., Tokyo, Japan

[21] Appl. No.: 628,837

[22] Filed: Jul. 9, 1984

[30] Foreign Application Priority Data

Jul. 19, 1983 [JP] Japan ..... 58-132400
Jul. 26, 1983 [JP] Japan ..... 58-137293

[51] Int. Cl.[3] ..... G03C 1/40; G03C 5/54; G03C 1/84

[52] U.S. Cl. ..... 430/213; 430/518; 430/941; 526/263

[58] Field of Search ..... 430/213, 941, 518; 101/464; 8/467; 526/263

[56] References Cited

U.S. PATENT DOCUMENTS

| | | | |
|---|---|---|---|
| 3,958,995 | 5/1976 | Campbell et al. | 430/941 |
| 4,154,615 | 5/1979 | Sato et al. | 430/213 |
| 4,312,940 | 1/1982 | Nakamura et al. | 430/213 |
| 4,353,972 | 10/1982 | Helling et al. | 430/213 |
| 4,396,698 | 8/1983 | Katino et al. | 430/213 |
| 4,401,629 | 8/1983 | Hancock et al. | 526/263 |

*Primary Examiner*—Richard L. Schilling
*Attorney, Agent, or Firm*—Jordan B. Bierman

[57] ABSTRACT

Photographic element used in color diffusion transfer processes comprising an image receiving layer containing a polymer having monomer units represented by either Formula I or Formula II wherein A is a copolymerizable monomer unit having at least two ethylenically unsaturated groups; B and B′ are copolymerizable $\alpha,\beta$-ethylenically unsaturated monomer units; each $R_1$ is independently hydrogen or methyl; $R_2$ and $R_3$ are independently hydrogen, alkyl, or aryl; $R_4$, $R_5$ and $R_6$ are independently alkyl groups; $L_1$ and $L_2$ are independently divalent combining groups; X is a monovalent anion; x, y, z, p, q, r, and s, are each copolymerization mole percentages as follows: $0.5 \leqq x \leqq 6$, $0 \leqq y \leqq 79.5$, $20 \leqq z \leqq 99.5$, $0 \leqq p \leqq 6$, $0 \leqq q \leqq 80$, $10 \leqq r \leqq 90$, and $10 \leqq s \leqq 90$.

26 Claims, No Drawings

PHOTOGRAPHIC ELEMENT WITH IMADAZOLE DYE MORDANT

FIELD OF THE INVENTION

The present invention relates to a photographic element having a novel polymer-containing layer, and more particularly to a photographic element for the color diffusion transfer process, which uses the novel polymer as a suitable mordant for dyeing.

DESCRIPTION OF THE PRIOR ART

In the color diffusion transfer process there are used those photographic materials comprising a light-sensitive element having a silver halide photographic emulsion-containing light-sensitive layer, etc., and an image receiving element into which is transferred the materials diffused from the light-sensitive element by development to form a color image. These are divided into two types: one in which the two elements are integrated into one, and the other in which the elements can be peeled apart. In any of these types, in the light-sensitive element the silver halide photographic emulsion-containing light-sensitive layer is exposed imagewise to form a latent image, which is developed in a processing solution to form a silver image, and at the same time the color image forming material forms an imagewise color image material. At least part of the color image material is diffused and transferred into the image-receiving layer of an image-receiving element superposed on the emulsion layer to thereby form a dye image. It is known that various polymer materials are used as the mordant to prevent the dye of the dye image thus formed in the image-receiving layer from moving to undesired portions. Among such polymer materials there are known those quaternary nitrogen atom-containing polymers as described in, e.g., U.S. Pat. Nos. 3,709,690 and 3,770,439, and Japanese Patent Open to Public Inspection (hereinafter referred to as Japanese Patent O.P.I. Publication) No. 22766/1980. These polymers, however, are not considered to have sufficient characteristics for the purpose. That is, the preservability of the image formed on the image-receiving layer containing such polymers used as the mordant is poor; the image becomes discolored with time by light.

For example, U.S. Pat. Nos. 4,273,853 and 4,282,305, and British Pat. No. 2,011,912 describe those polymers containing imidazole group, but the polymers are not considered to have sufficient characteristics, either. Namely, the polymers themselves, when used as the mordant in the image receiving layer, can move into other hydrophilic colloidal layers. The moved mordant causes an acid dye that has diffused in to other colloidal layers to hinder the color image formation in the image-receiving layer. Further, the dye can become attaching to or detaching from the moved mordant later to produce a dye stain.

On the other hand, even other compounds capable of satisfying these conditions have been found disadvantageous in respect that they are poor in the layer-forming capability; they cause the coating composition's viscosity to become so high as to make it difficult to coat the composition uniformly; the resulting color image's stability is inadequate; and the like.

In order to solve the above-described disadvantages, many attempts have been made extensively to find novel polymers to be used as the mordant in the image-receiving layer.

OBJECTS OF THE INVENTION

The present invention relates particularly to a photographic element containing novel polymers as the mordant, which element is used in the color diffusion transfer process.

It is, therefore, an object of the present invention to provide a photographic element comprising an image-receiving layer excellent in the image preservability.

It is another object of the present invention to provide a photographic element comprising an image-receiving layer having an excellent mordanting ability.

It is a further object of the present invention to provide a photographic element capable of giving rapidly a high-density, excellent color-having dye image by mordanting in a developing process a color image forming material when diffused into the image-receiving layer.

It is still another object of the present invention to provide a photographic element containing an excellent polymer capable of mordanting without adversely affecting the photographic characteristics thereof.

It is a still further object of the present invention to provide a photographic element containing as the mordant a polymer which itself is excellent in the layer formability and which, even when used in combination with a binder, has an excellent layer formability.

DETAILED DESCRIPTION OF THE INVENTION

The above objects of the present invention are accomplished by a photographic element comprising a polymer containing units having the following Formula (I) or (II):

Formula (I)

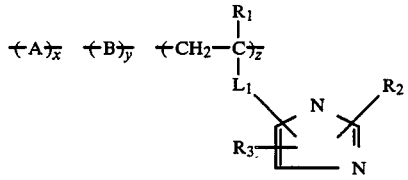

wherein $R_1$ is hydrogen or methyl group, and $R_2$ and $R_3$ each is hydrogen, an alkyl or aryl group.

The alkyl group represented by the $R_2$ or $R_3$ is desirable to have from 1 to 4 carbon atoms, and allowed to have a substituent that is desirable to be an aralkyl or aryl group, the aralkyl or aryl group being desirable to be such that the total number of the carbon atoms of the $R_2$ or $R_3$ including the substituent is in the range of from 6 to 12.

$L_1$ is a divalent combining group, and preferably a complex combining group consisting of subordinate divalent combining group $l_1$ and $l_2$ in the form of $-l_1-l_2-$. In the complex combining group $-l_1-l_2-$, the $l_2$ is the imidazole-side combining group in Formula (I).

The foregoing $l_1$ includes an arylene group, an acid amid group, or an ester group, and preferably a phenylene group, a carbonylamino group or a carbonyloxy group.

The foregoing $l_2$ is an alkylene group. The alkylene group is desirable to have from 1 to 4 carbon atoms, and allowed to have a substituent. The total number of the carbon atoms of the $l_2$ and the substituent is from 7 to 12.

In addition, the alkylene having a substituent includes, for example, an arylene-alkylene group.

The bonding position of the imidazole-side combining group $l_2$ of the complex combining group $L_1$ in the imidazole ring is allowed to be any position, but desirable to be the first position.

Formula (II)

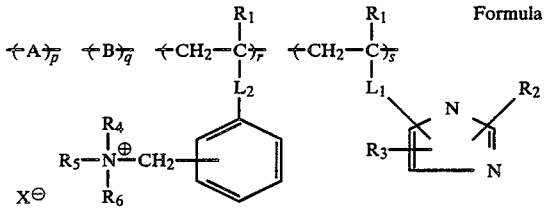

Formula (II) is of a certain specific case of Formula (I). In Formula (II), $R_1$, $R_2$ and $R_3$ each is as defined in Formula (I), and $R_4$ and $R_5$ each is an alkyl group which is allowed to have a substituent, and the total number of the carbon atoms of the group and substituent is desirable to be from 1 to 4. $R_6$ is an alkyl or aryl group, and allowed to have a substituent. The preferred total number of the carbon atoms of the alkyl and aryl each including a substituent is from 1 to 16 and from 7 to 12, respectively.

$X^{\ominus}$ represents a monovalent anion, and preferably a halogen ion or an alkyl sulfate ion.

The $L_1$ is as defined in Formula (I), and the $L_2$ is a divalent combining group which is an acid amido or ester group, preferably an acid amido group, and most preferably a carbonylamido group.

The preferred bonding position of the quaternary ammonium salt portion combined through the methylene group with the benzene ring is the m- or p-position with respect to the bonding position of the combining group $L_2$, and a complex of the salt portions in both positions also displays the same effect. The bonding position of the imidazole group with the $L_1$ is allowed to be any point on the imidazole ring, but the first position is desirable.

In Formulas (I) and (II), the A is a copolymerizable monomer having at least two ethylenically unsaturated group. The preferred one as the A includes those monomers having the following Formula (III):

Formula (III)

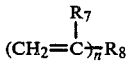

wherein n is an integer of not less than 2, and preferably 2; $R_7$ is one selected from the group consisting of hydrogen and a methyl group; and $R_8$ is a combining group having n number of bonding group and includes, for example, alkylene group (such as ethylene, trimethylene, phenyl-ethylene, etc.), alkylidene group (such as ethylidene, isopropylidene, etc.), alkylidine group (such as methylidine, trichloroethylidine, etc.), an arylene group (such as phenylene), —CONH—, —$SO_2$NH—, —COO—, and further such various group-combined combining group [such as methyleneoxycarbonyl, ethylenebis(oxycarbonyl), phenylenebis(oxycarbonyl), 4,4'-isopropylidenebis(phenyleneoxycarbonyl), 1,2,3-propanetriyltris(oxycarbonyl), cyclohexylenebis(methyleneoxycarbonyl), methyleneoxymethylenecarbonyloxy, methyleneiminocarbonyl, oxymethyleneoxy, ethylenebis(oxyethyleneoxycarbonyl), ethylidinetris(oxycarbonyl)].

The preferred monomers having Formula (III) include, e.g., divinyl benzene, allylacrylate, N-allylmethacrylamide, 4,4'-isopropylidene-diphenyl-diacrylate, 1,3-butylene-dimethacrylate, 1,4-cyclohexylene-dimethylene-dimethacrylate, diethylene-glycoldimethacrylate, divinyloxymethane, ethylene-diacrylate, ethylidene-dimethacrylate, 1,6-diacrylamidohexane, N,N'-methylenebisacrylamidoneopentyl-dimethacrylate, phenyl-ethylene-dimethacrylate, tetraethylene-glycol-dimethacrylate, tetramethylenediacrylate, 2,2,2-trichloroethylidene-dimethacrylate, triethylene-glycol-dimethacrylate, ethylidene-trimethacrylate, propylidine-triacrylate, vinyl-aryloxyacetate, vinyl-methacrylate, 1-vinyloxy-2-allyloxyethane. The most preferred one is divinyl benzene.

In Formulas (I) and (II), the B and the B' are copolymerizable $\alpha,\beta$-ethylenically unsaturated monomers, useful examples of which include alkenes (such as ethylene, propylene, 1-butene, isobutene, 2-methyl-pentene); alkapolyenes (such as 1,1,4,4-tetramethyl-butadiene, isoprene); styrenes (such as styrene, $\alpha$-methyl-styrene, p-chlorostyrene, p-methyl-styrene, m-ethyl-styrene); monoethylenically unsaturated esters of fatty acid (such as vinyl acetate, allyl acetate), ethylenically unsaturated mono- or dicarboxylic acid esters (such lower alkyl esters of methacrylic acid as methyl methacrylate; such lower alkyl esters of acrylic acid as butyl acrylate; diethylmethylene malonate); halogenated olefins such as vinylidene chloride; dienes such as butadiene; nitriles such as acrylonitrile; acrylamides such as acrylamide, methacrylamide, diacetone-acrylamide, vinyl ethers such as vinyl-ethyl ether, N-vinyl-pyrolidone; fluorinated vinyl compounds such as

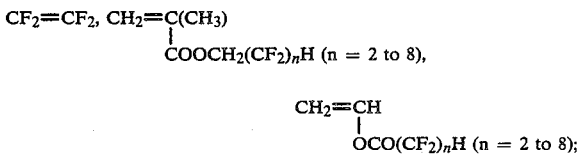

and the like. The preferred ones among these compounds are styrenes and ethylenically unsaturated monocarboxylic acid esters.

In Formula (I), the x, y and z represent the copolymerization molar percentages of the respective monomer units, and fall under the ranges $0.5 \leqq x \leqq 6.0$, $0 \leqq y \leqq 79.5$ and $20 \leqq z \leqq 99.5$, respectively. With respect to z, the range is preferably $25 \leqq z \leqq 70$.

The respective monomer units represented by the A, B and

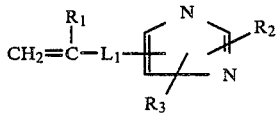

are each allowed to comprise monomers of two or more kinds if the copolymerization molar percentages of these units are within the ranges specified above as the x, y and z, respectively.

In Formula (II), the p, q, r and s represent the copolymerization molar percentages of the respective monomer units and fall under the ranges $6.0 \geqq p \geqq 0$, $80 \geqq q \geqq 0$, $90 \geqq r \geqq 10$, and $90 \geqq s \geqq 10$, respectively. With respect to r and s, the ranges are preferably $70 \geqq r \geqq 25$ and $70 \geqq s \geqq 25$, respectively.

The respective monomer units represented by the A, B and

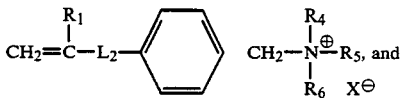

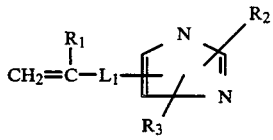

each allowed to comprise monomers of two or more kinds if the copolymerization molar percentages of these units are within the ranges specified as the p, q, r and s, respectively.

The polymers used in the present invention are water-dispersible polymers and characterized by comprising monomer units having an imidazole group on the side chain forming portion thereof as shown in Formulas (I) and (II).

The foregoing objects of the present invention have been accomplished because of these characteristics, which are advantageous in respect that the polymers have satisfactorily mordanting ability as compared to those polymers as described in British Pat. No. 2,011,912, e.g.,

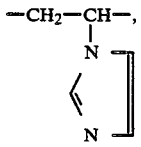

having monomer units similar structurally to the above monomer units of the present invention, and also in respect that the water-dispersible polymers are easily producible.

Those monomers used in emulsion polymerization are generally desirable to be in the liquid form in the reaction system thereof at a polymerization temperature. Even in the liquid form, if the monomers to be used differ in the hydrophilicity, then the emulsifying agent, polymerization method, etc., should be changed according to the hydrophilicity, so that a different method must be employed. If the hydrophilicity is too large, the emulsion polymerization reaction becomes so unstable that no water-dispersible polymer can be produced. In selecting monomers, therefore, in addition to the melting points of monomers, such factors as the hydrophilicities, copolymerizabilities, thermal stabilities, chemical reactivities, and the like, must be taken into account.

The previously enumerated monomers usable in producing the polymer of the present invention are excellent also in this respect.

The above-mentioned emulsion polymerization generally takes place in the presence of an anionic surface active agent and polymerization initiator. The anionic surface active agent usable in the present invention includes, e.g., sodium lauryl-sulfate, sodium salt of the sulfuric acid condensate of alkyl phenol and ethyleneoxide, such as, e.g., "Triton 770" produced by Rohm & Hass Co., and the like.

The preferred example of the polymerization initiator is an alkaline metallic salt of azobiscyanovaleric acid.

In an actual emulsion polymerization reaction system, azobiscyanovaleric acid and an alkali (e.g., potassium hydroxide or sodium hydroxide) should be added. The alkali may be added in only a quantity necessary for neutralizing the acid portion of azobiscyanovaleric acid, but may also be added in excess of the quantity. The addition in excess neutralizes the sulfuric acid derived from the decomposed product of the surface active agent to thereby reduce the influence of the acid upon the tertiary amine portion. Those redox-type free group initiator such as potassium persulfate-sodium sulfite, ammonium persulfate-sodium hydrogen-sulfite, hydrogen peroxide-$Fe^{2+}$, as described in U.S. Pat. No. 3,958,995, are not suitable in respect of producing a dye stain. The emulsion polymerization temperature cannot be determined equally in relation to the physical properties of the monomers used, but is desirable to be such a temperature as facilitating the emulsification-dispersion by stirring the polymerization reaction system, and is normally from 65° to 90° C., and more preferably from 70° to 85° C.

The polymer containing a quaternary ammonium salt as in Formula (II) can be synthesized in the manner that, as will be described hereinafter, a corresponding quaternary ammonium salt monomer is polymerized, or a precursor monomer reacting to produce a quaternary ammonium salt is polymerized, and after that the quaternary ammonium salt is produced by a polymer reaction.

For the production of such a quaternary ammonium salt-containing water-dispersible polymer as the polymer having Formula (II), there are well known, as described in U.S. Pat. No. 3,958,995, a method that a halogenated alkyl group-having monomer, at least two ethylenically unsaturated group-having monomer, and α,62 -ethylenically unsaturated group-having monomer are emulsified and polymerized, and after that are caused to react with a tertiary amine, and another that in place of the above halogenated alkyl-having monomer a tertiary amino-having monomer is used to make an emulsification/polymerization, and then the polymerized product is caused to react with a quaternary salt producing agent. However, the former is not suitable because the unreacted tertiary amine remains which will cause a "repellent spots" phenomenon in the coating or will adversely affect the photographic characteristics.

The polymer of the present invention is very suitable for the production thereof by the latter method, which is advantageous for the photographic characteristics.

The terms "water-dispersible polymer" used herein means a polymer in such the condition that the polymer is transparent or slightly turbid in the eye, but is found dispersed in a very finely particulate state when viewing through an electron microscope.

The terms "substantially aqueous" used herein means that water accounts for normally not less than 90% by weight, and preferably not less than 95% by weight, of the principal part of the dispersion medium in a dispersed composition. As the remainder of the dispersion medium such hydrophilic organic solvents as, e.g., methanol, ethanol, methyl cellosolve, dioxane, N,N-dimethyl-formamide, and the like, may be used alone or in a mixture.

The molecular weight of the polymer of the present invention may be arbitrary, but a low molecular weight may be undesirable in respect of the mordanting ability or dye fixability, while a large molecular weight may be undesirable in respect of the layer formability or coatability. Satisfactory results will be obtained when the molecular weight is in the range of from about 5,000 to about 1,000,000, and preferably from about 10,000 to about 500,000.

The following are typical examples of the polymer of the present invention, but the present invention is not limited thereto.

Exemplified Polymers

1.

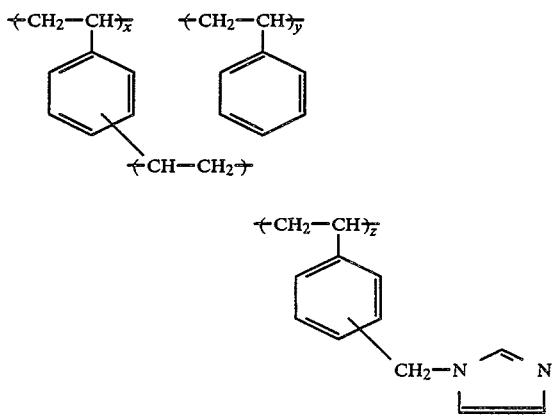

x:y:z = 4:26:70

(m- and p-positions are mixed: the same shall apply hereinafter)

2.

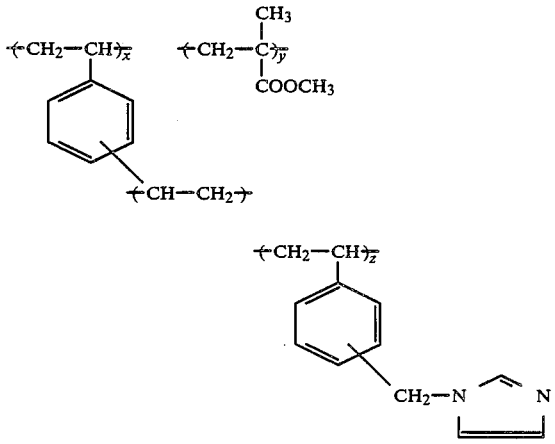

x:y:z = 4:28:68

3.

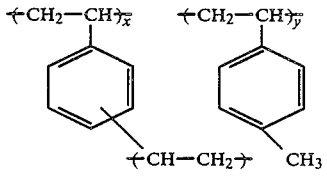

-continued

Exemplified Polymers

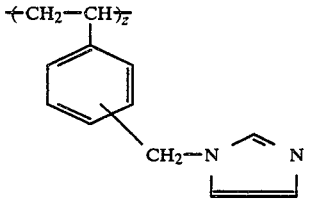

x:y:z = 4:26:70

4.

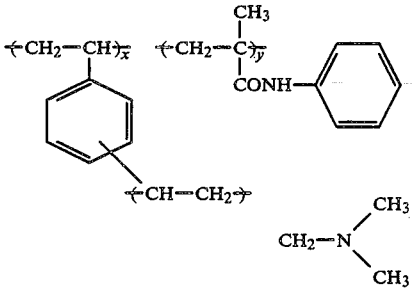

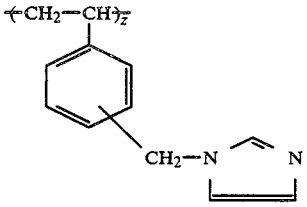

x:y:z = 4:26:70

5.

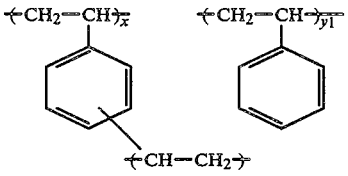

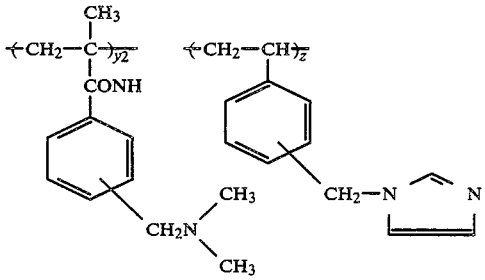

x:y1:y2:z = 4:26:20:50

6.

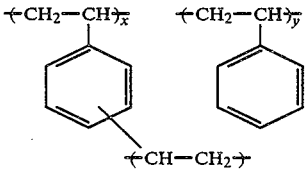

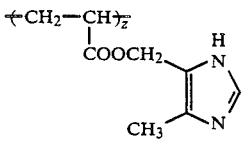

-continued
Exemplified Polymers
x:y:z = 4:48:48
7.
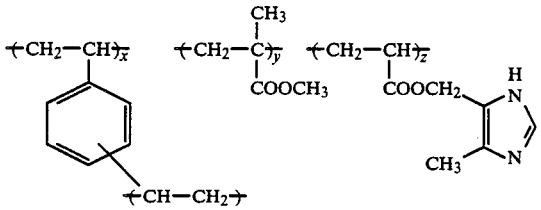
x:y:z = 4:48:48
8.
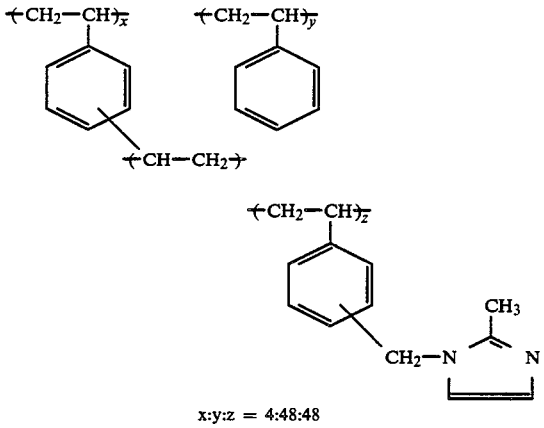
x:y:z = 4:48:48
9.
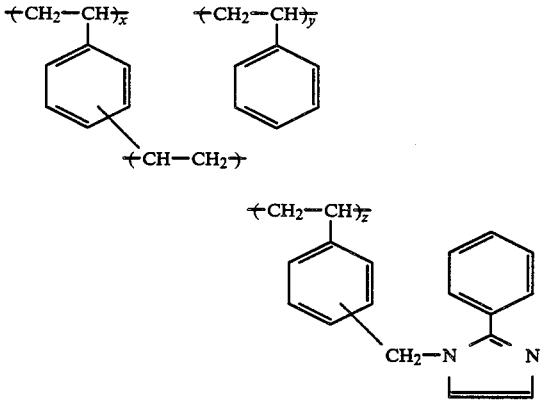
x:y:z = 4:48:48
10.
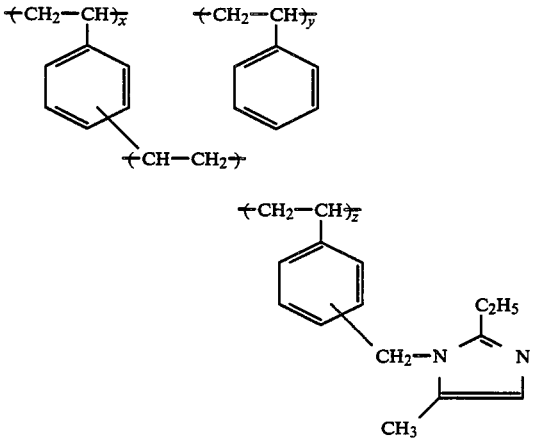
x:y:z = 4:48:48
-continued
Exemplified Polymers
11.
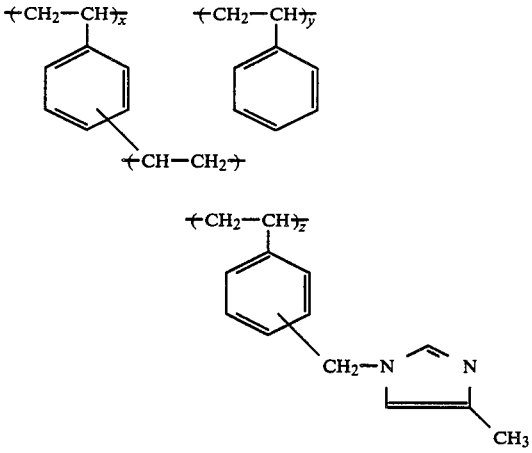
x:y:z = 4:48:48
12.
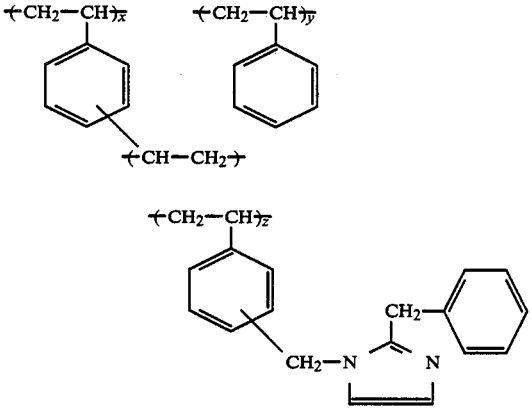
x:y:z = 4:48:48
13.
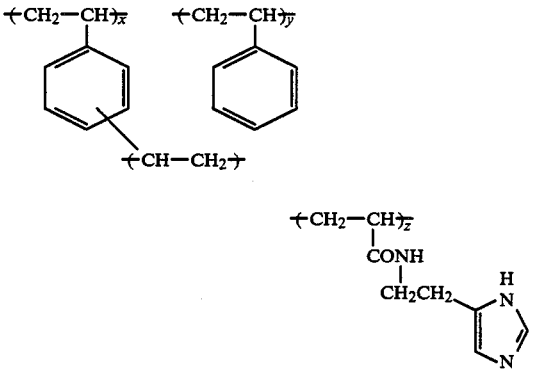
x:y:z = 4:48:48
14.
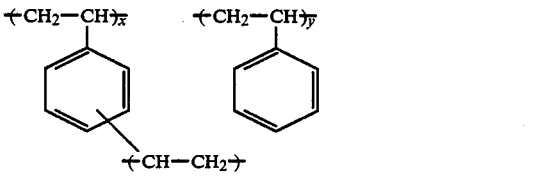

-continued
Exemplified Polymers
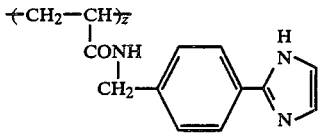
x:y:z = 4:48:48
15.
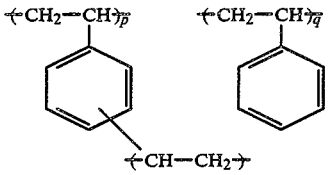
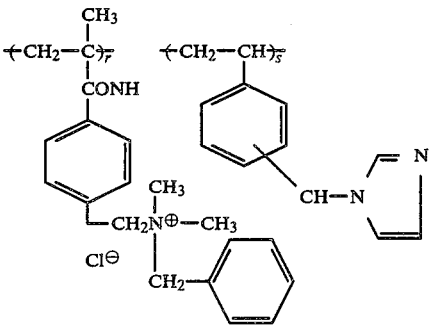
p:q:r:s = 4:46:30:20
16.
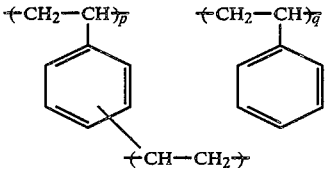
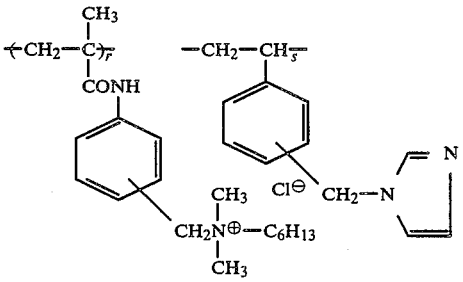
p:q:r:s = 4:46:20:30
(m- and p-positions are mixed: the same shall apply hereinafter)
17.
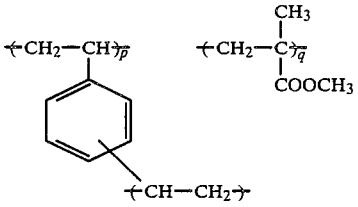
-continued
Exemplified Polymers
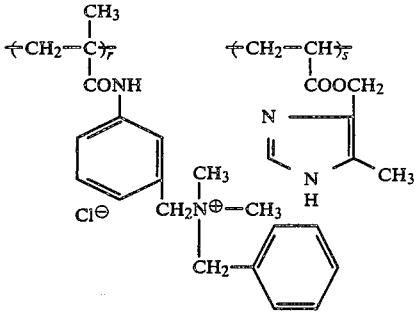
p:q:r:s = 4:46:40:10
18.
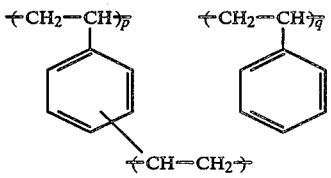
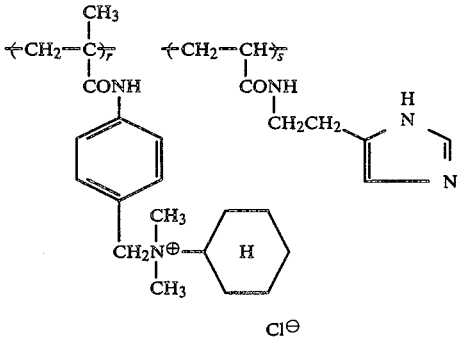
p:q:r:s = 4:38:48:10
19.
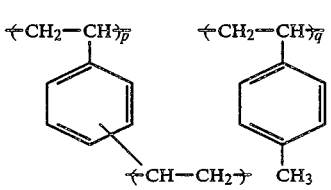
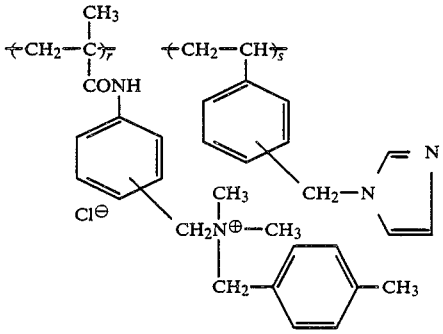
p:q:r:s = 2:20:48:30

-continued
Exemplified Polymers
20.
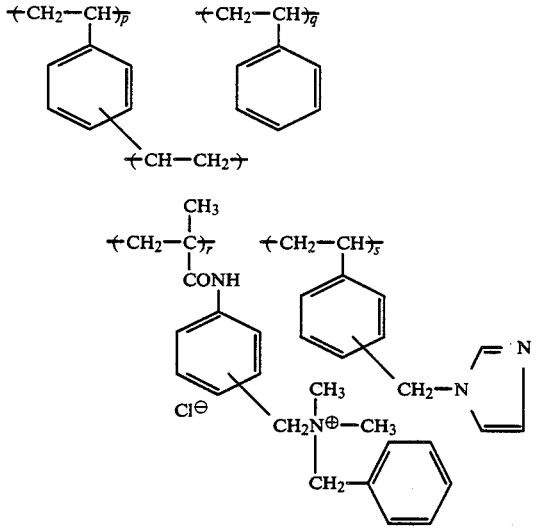
p:q:r:s = 4:28:48:20
21.
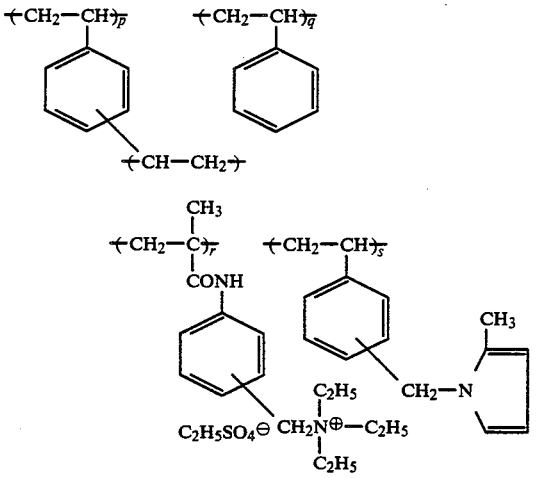
p:q:r:s = 4:28:48:20
22.
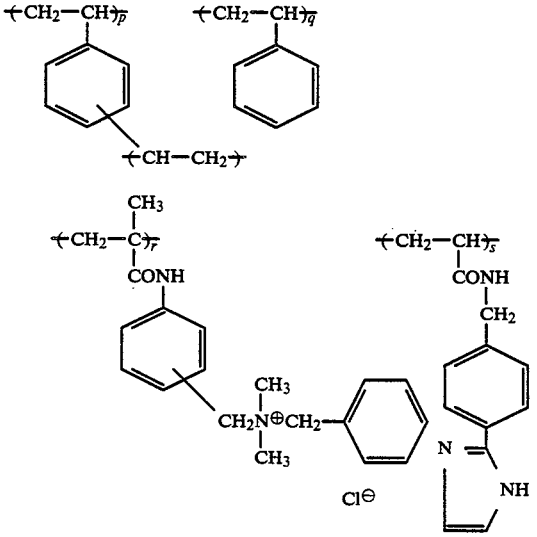
p:q:r:s = 4:38:48:10
-continued
Exemplified Polymers
23.
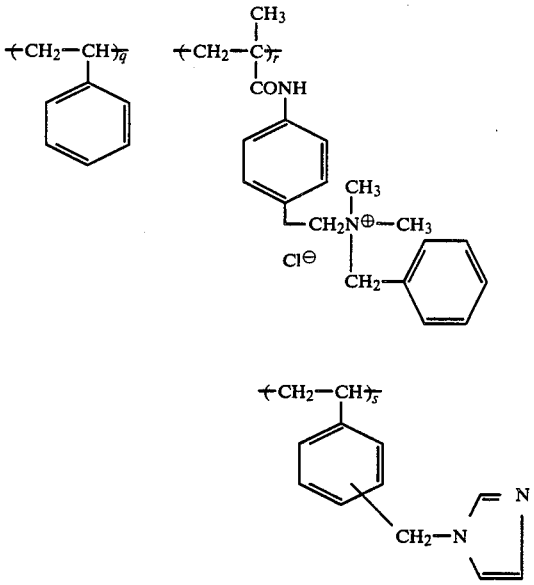
q:r:s = 50:30:20
24.
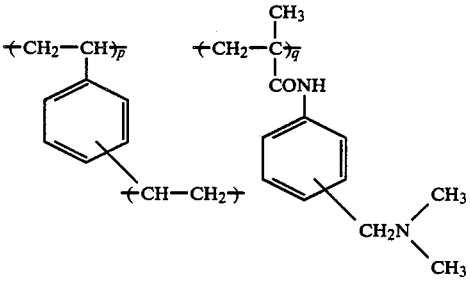
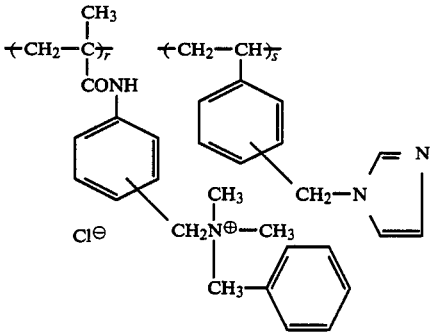
p:q:r:s = 4:10:38:48
25.
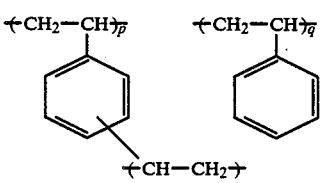

-continued
Exemplified Polymers
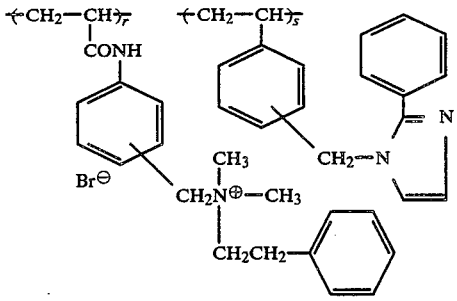
p:q:r:s = 4:38:48:10
26.
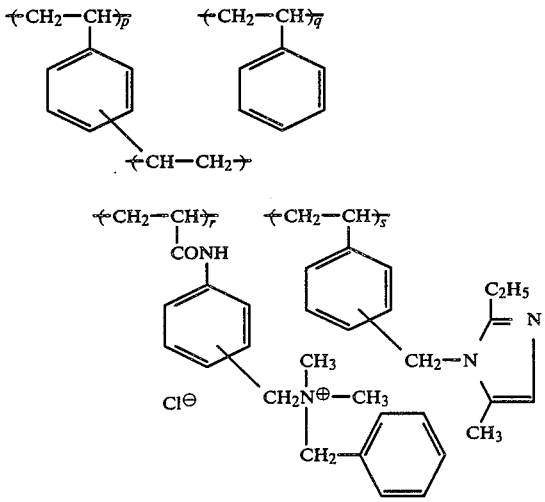
p:q:r:s = 4:28:48:20
27.
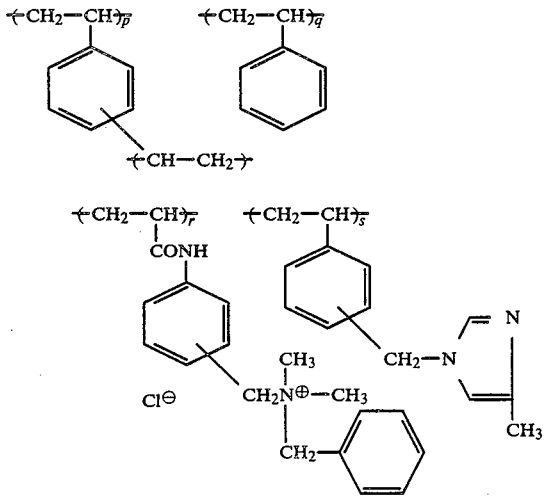
p:q:r:s = 4:46:35:15
28.
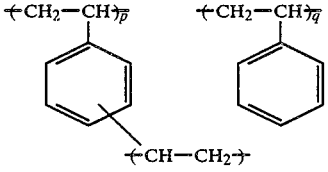
-continued
Exemplified Polymers
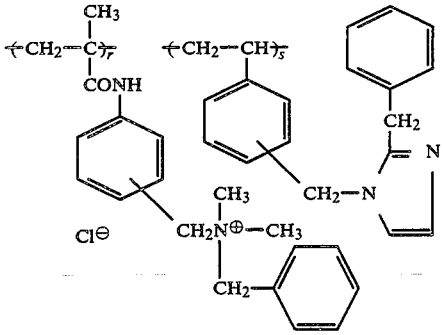
p:q:r:s = 4:28:48:20
29.
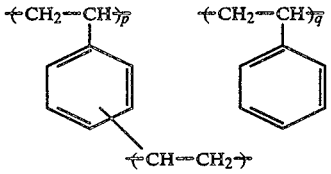
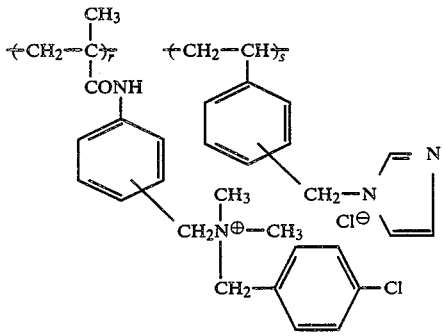
p:q:r:s = 4:28:48:20
30.
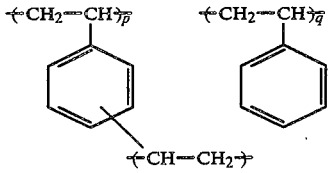
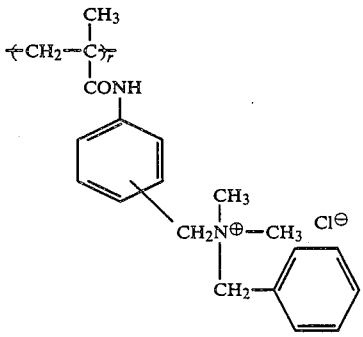

-continued

Exemplified Polymers

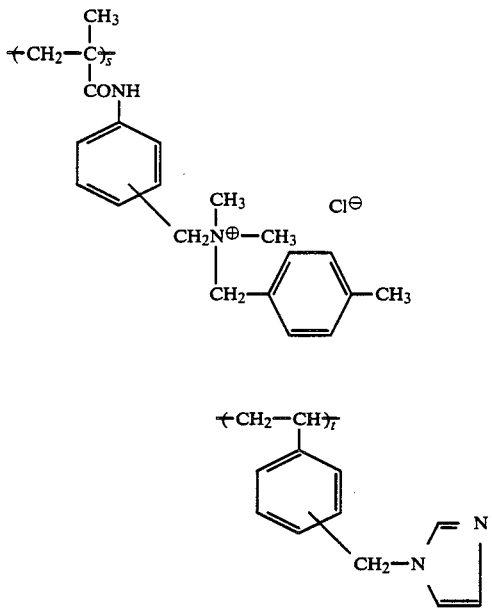

p:q:r:s:t = 4:28:38:10:20

31.

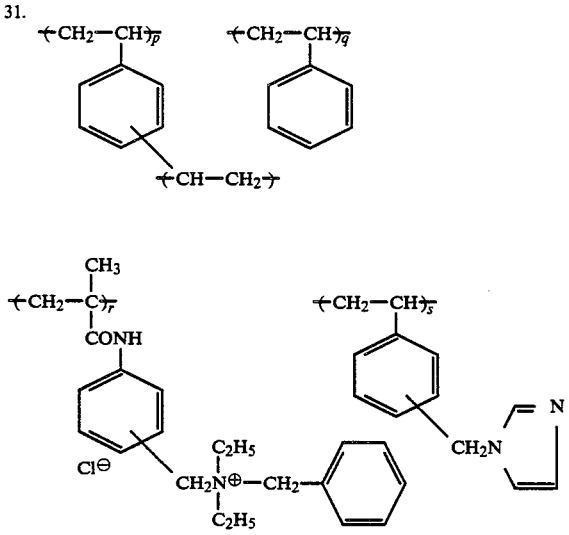

p:q:r:s = 4:48:35:13

32.

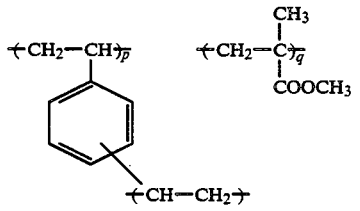

-continued

Exemplified Polymers

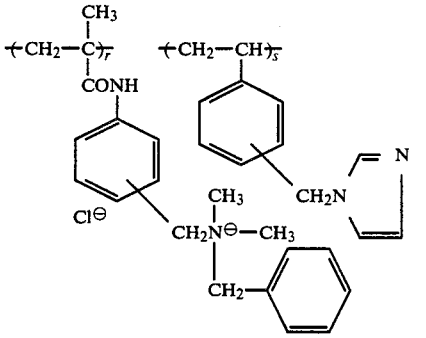

p:q:r:s = 4:28:48:20

The layer containing the polymer of the present invention is preferably used as the image-receiving layer of a photographic element in the color diffusion transfer process. This photographic element can be in any form as long as it comprises a support having thereon a layer containing the polymer of the present invention. That is, a layer containing the polymer of the present invention may be coated on a support that is coated thereon with in order an acid material-containing neutralizing layer and a timing layer, or without coating the above neutralizing layer and timing layer, the layer containing the polymer of the present invention may be coated directly on a support.

The polymer of the present invention can harden in itself to form a layer capable of mordanting, and may also be used in combination with a binder (preferably a binder consisting of a water-miscible hydrophilic organic colloid) to form a layer capable of mordanting. Suitably usable binders are those layer-formable compounds including, e.g., gelatin, such gelatin derivatives as acid-treated gelatin, etc., polyvinyl alcohol, carboxymethyl cellulose, hydroxyethyl cellulose, starch, polyvinyl-methyl ether, polyacrylamide, polyvinyl pyrolidone, and the like. The percentage by weight of the polymer of the present invention to be contained in the image-receiving layer is desirable to be from 10 to 100%.

The coating thickness of the image-receiving layer containing the polymer of the present invention may be varied according to purposes, and the optimum thickness is from 3 to 10 $\mu$m. The image-receiving layer may contain various additives used in ordinary photographic techniques, such as ultraviolet absorbing agents, brightening agents, and the like.

The photographic element comprising a support and a layer as the image-receiving layer containing the polymer of the present invention may be used in various known photographic materials (such as, e.g., color diffusion transfer photographic materials, dye-transfer process or imbibition printing process), but one of the most preferred embodiments is the case where it is used as the photographic element of the color diffusion transfer photographic materials.

As the color diffusion transfer photographic material which uses the photographic element of the present invention, a first preferred embodiment is one which comprises:

(1) a photographic element comprising a first support having thereon as the essential layer an image-receiving layer containing a polymer having Formula (I), and (2) another photographic element comprising a second support having thereon at least one light-sensitive silver halide emulsion layer in combination with a color image forming material.

A second preferred embodiment is one which comprises:

(1) a photographic element comprising a support having in order as the essential layer an image-receiving layer containing a polymer having Formula (I) and at least one light-sensitive silver halide emulsion layer in combination with a color image forming material, and (2) a processing sheet which is or can be superposed upon the layer positioned furthest from the support of the above photographic element.

The color diffusion transfer photographic element, photographic material or film unit of the present invention may, if necessary, comprise an acid material-containing layer (neutralizing layer), neutralizing rate control layer (timing layer), reflective agent-containing layer, opacifying agent-containing layer, separation layer, and the like. The neutralizing layer and timing layer, if they need to be provided on a support having a layer containing the polymer of the invention or a silver halide emulsion layer, are desirable to be provided in the order of the neutralizing layer and then the timing layer from the support side between the support and the layer containing the polymer of the invention or silver halide emulsion layer provided thereon. The neutralizing layer and timing layer, when desired to be provided on a support having both layer containing the polymer of the invention and silver halide emulsion layer, are desirable to be provided in the order of the neutralizing layer and then the timing layer from the support side between the support and the polymer-containing and emulsion layers. When providing the neutralizing layer and timing layer on the foregoing processing sheet, they are desirable to be provided in the order of the neutralizing layer and then the timing layer from the sheet side. When the reflective agent-containing layer and opacifying agent-containing layer are to be provided on a support having both present invention's polymer-containing layer and silver halide emulsion layer, these layers are desirable to be provided in the order of the polymer-containing layer, the reflective agent-containing layer, the opacifying agent-containing layer and then the emulsion layer from the support side. The separation layer, when it should be provided on a support having both invention's polymer-containing layer and silver halide emulsion layer, is desirable to be provided in between the invention's polymer containing layer and the emulsion layer.

As the color image forming material to be used in combination with the silver halide emulsion layer, those various known materials may be used regardless of whether they are substantially diffusible or not. As typical examples of the material, a first color image forming material is a dye developer. The dye developer is a compound having in the molecule thereof a dye portion or its precursor portion and silver halide developer portion together, and the dye developer as the color forming material is oxidized by the silver halide, whereby the diffusibility of the dye developer is changed.

A second typical color image forming material is a diffusible dye releasing-type coupler which makes a coupling reaction with the oxidized product of a silver halide color-developing agent oxidized by the silver halide to thereby release a diffusible dye or the precursor thereof.

A third typical color image forming material is a nondiffusible color image forming material which is oxidized by the oxidized product of a silver halide developer to thereby release in an alkaline medium a diffusible dye or the precursor thereof (the material is called "Dye Releasing Redox Compound." Hereinafter abbreviated to DRR compound).

Further, a fourth typical color image forming material is a nondiffusible dye image forming material whose release of a diffusible dye or the precursor thereof is hindered as the function of the oxidized product of a silver halide developer in an alkaline medium.

When the above third color image forming material, i.e., DRR compound, the light-sensitive silver halide emulsion layer is exposed to light to thereby form a latent image thereinside, and the developed in an alkaline processing solution in the presence of a silver halide developer.

As a result of the processing in the processing solution, where the oxidized product of the silver halide developer is produced, whereby the DRR compound is oxidized by the oxidized product of the silver halide developer to release a diffusible dye or the precursor thereof.

The diffusible dye or the precursor thereof which has been released from the DRR compound diffuses to be transferred to the foregoing image-receiving layer to thereby form a color image thereon.

When the above fourth color image forming material is used, the light-sensitive silver halide emulsion layer is exposed to light to thereby form a latent image thereinside, and then developed in an alkaline processing composition solution in the presence of a silver halide developer.

As a result of the processing in the alkaline processing solution, where the oxidized product of the silver halide developer is produced, the release of the diffusible dye or the precursor thereof from the above nondiffusible color image forming material is hindered. On the other hand, where no oxidized product of the silver halide developer is produced, the diffusible dye or the precursor thereof is released from the above nondiffusible color image forming material and diffuses to be transferred to the image-receiving layer to thereby form a color image thereon.

The polymer of the present invention represented by Formula (I) has a satisfactory mordanting ability particularly to an acid dye or the precursor thereof. The acid dye or the precursor thereof has such a group as sulfone, carboxy, ionizable sulfamoyl or hydroxyl-substituted aromatic hydrocarbon cyclic or heterocyclic group.

In the photographic material of the present invention, as previously mentioned, various color image forming materials may be used, among which the preferred ones are those color image forming materials, particularly DRR compounds, which, as a result of being processed in an alkaline processing composition, produce an ionizable sulfamoyl group-having diffusible dye or the precursor thereof.

In the case of the foregoing first and fourth typical color image forming materials, if a negative-type silver halide emulsion layer is used and processed, then a positive diffusion transfer dye image is obtained. In contrast, in the case of the foregoing second and third color image forming materials, if a negative-type silver halide emulsion layer is used and processed, then a negative-type diffusion transfer dye image is obtained. For this reason, in order to obtain a positive-type diffusion transfer dye image with use of the second color image forming material, a reversal process is required; for example, a direct positive-type emulsion, i.e., an internal latent image-type emulsion, and a fogged-type emulsion will apply to this process. Alternatively, a layer containing both color image forming material and physical development nucleus may be provided adjacently to the negative-type silver halide emulsion layer and these may be processed in a developer solution containing a silver halide solvent. Further, a layer containing a color image forming material and spontaneously reduceable metallic salt may be provided adjacently to a negative-type silver halide emulsion layer containing a compound which reacts with the oxidized product of a developing agent to release such a development inhibitor as 1-phenyl-5-mercaptotetrazole. In the present invention, the combination of these emulsions and color image forming materials can be used, and negative and positive dye image-giving processes may be arbitrarily selected to be used.

These color image forming materials used in the present invention are desirable to be dispersed in various manners according to the type of the color image forming material used into normally the combinedly used silver halide emulsion layer or into preferably such a hydrophilic protective colloid layer, the binder of a layer located on the exposure-receiving side of and adjacent to the emulsion layer.

The using quantity of the color image forming material used in the present invention may be extensively varied according to the compound to be used and desirous results; for example, the preferred quantity range is from 0.5 to 10% by weight in a hydrophilic protective colloid coating liquid. If what diffuses to be transferred into the image-receiving layer is not a dye but such a dye precursor as a leuco dye or a coupler, in order to change it into a dye, for example, it is desirable to incorporate into the image receiving layer an oxidizing agent, color developing agent, diazonium compound, or the like. Such the image-receiving layer containing an oxidizing agent, color developing agent, diazonum compound, or the like, is described in U.S. Pat. Nos. 2,647,049, 2,698,798 and 3,676,124; French Pat. Nos. 2,232,776 and 2,232,777; and Japanese Patent O.P.I. Publication No. 80131/1975.

The silver halide emulsion usable in the present invention may be a colloidal material into which is dispersed silver chloride, silver bromide, silver chlorobromide, silver iodobromide, silver chloroiodide or a mixture of some of these silver halides.

To the silver halide emulsion used in the present invention, in order to provide an additional light-sensitivity to it, optically sensitizing dyes may be used. To obtain a multicolor image, it is desirable to superpose a blue-sensitive emulsion layer, a green-sensitive emulsion layer and a red-sensitive emulsion layer in the described order from the exposure-receiving side, and to use in combination with these emulsion layers an yellow color image forming material, magenta color image forming material and a cyan color image forming material, respectively. In this instance, it is desirable to provide interlayers each between the combined units of the color image forming material and silver halide emulsion layer. The interlayer functions to not only prevent undesirable interactions possibly occurring between the combined units of the emulsion layer different in the color sensitivity and color image forming material but control the diffusion of the diffusible dyes or precursors thereof and of the alkaline processing composition. As the reflective agent and opacifying agent usable for the foregoing reflective agent-containing layer and the opacifying agent-containing layer, there may be used those similar to the reflective agents and opacifying agents used in the alkaline processing composition that will be described hereinafter. The photographic element or photographic material of the present invention may, if necessary, be provided with such layers as an yellow filter layer, antihalation layer, protective layer, and the like.

The neutralizing layer usable in the present invention may be any as long as it contains an acid material (neutralizing layer) to lower the pH inside the post-development system. A material to be used as the neutralizing agent is desirable to be a layer-formable polymeric acid having a carboxyl group, sulfone group or such a group as to form a carboxyl group by hydrolysis. Any material may be used as long as it is such a polymeric acid. The foregoing timing layer functions to retard the lowering of the pH until completion of a required development and transfer. That is, it prevents the undesirable reduction of the transferred image density caused by the premature lowering of pH inside the system by the neutralizing layer prior to the development of the silver halide and the diffusion transfer image formation.

The support or processing sheet used in the present invention is desirable to be a flat material that will not cause any significant dimensional change during the processing thereof in a processing solution. For the purpose of preventing the light reflection in exposure or in observing the resulting image, the support may be provided with an anti-reflection layer as described in U.S. Pat. Nos. 3,793,022 and 4,047,804, or the surface of the support may be roughened as described in U.S. Pat. No. 4,040,830.

Such the developer-permeable layers as the silver halide emulsion layer, color image forming material-containing layer, reflective agent-containing layer, opacifying agent-containing layer and protective layer used in the present invention are desirable to contain as the binder a hydrophilic polymer, preferably gelatin.

As the developer used in the present invention, any developer can be used as long as it is a liquid composition containing processing components required for the development of the silver halide emulsion as well as for the diffusion transfer image formation. As the solvent for the processing components, water on such a hydrophilic solvent as methanol, methyl cellosolve, etc., may be arbitrarily used. The processing liquid is desirable to contain an alkaline agent in a quantity enough to neutralize an acid that maintains the pH necessary for causing the development of the emulsion layer and is produced during the course of the development and the color image formation.

In the present invention, in order to form a white background of the image formed in the image-receiving layer, it is desirable to provide a light-reflective material-containing layer. Appropriate materials usable as the light-reflective material include titanium dioxide, barium sulfate, zinc oxide, barium alumina-stearate, calcium carbonate, silicate zirconium oxide, kaolin, magnesium oxide, and the like, and these may be used alone or in a mixture.

The polymer of the present invention having Formula (I) has been described above mainly with respect to the case where the polymer is used as the mordant for the image-receiving layer in the color diffusion transfer process. The polymer, however, may also be used as a scavenger to prevent the increase in the minimum density of the transfer image or to prevent the occurrence of stain due to the diffusion into the image-receiving layer of the excessive diffusible dye or the precursor thereof or impurities which are undesirable to the transfer image formation. When using the polymer having Formula (I) as the scavenger, the place in which the polymer is incorporated is the inside of a photographic material, and preferably a layer positioned on the reverse side to the image-receiving layer with respect to the silver halide emulsion layer at the time of processing, or a layer interposed between the silver halide emulsion layer and the image-receiving layer, which interposed layer can be any of such various layers according to the construction of a photographic material as, e.g., timing layer, interlayer, protective layer, etc. Alternatively, for example, an additional scavenger layer containing the polymer may also be provided in, e.g., between the timing layer and the neutralizing layer or between the opacifying agent-containing layer and the silver halide emulsion layer. When the polymer is used as the scavenger, the mordant in the image-receiving layer may be either the polymer of the invention or a different polymer. The adding quantity of the polymer of the present invention when used as the scavenger, if it is added to a layer positioned on the reverse side to the image-receiving layer with respect to the silver halide emulsion layer as mentioned above, is preferably from 0.2 to 3 g/m$^2$, and if it is added to a layer interposed between the silver halide emulsion layer and the image-receiving layer, is preferably from 20 to 160 mg/m$^2$.

The polymer of the present invention, without being limited to the color diffusion transfer process, may be used also in the wash-off releaf process as well as in the imbibition printing process such as the dye transfer process. That is, by transferring the dyes from a matrix of the dye tranfer process onto a photographic element comprising a layer containing the polymer of the invention and a support, a satisfactory dye image can be obtained. Those dyes usable in the dye transfer process include Pontacyl Green SN Ex (color index 737), Tartrazine (color index 640), Acid Magenta 0 (color index 692), and the like. Further, the polymer of the present invention can also be used for a light-filter layer such as, e.g., an antihalation layer as described in U.S. Pat. No. 3,282,699. This light-filter layer contains preferably the polymer of the invention, a filter dye mordanted to the polymer and a hydrophilic binder.

The present invention will be illustrated in detail by the following examples, but the invention is not limited thereto.

SYNTHESIS EXAMPLE 1

Synthesis of N-vinylbenzylimidazole

Into a 1-liter flask were put 140 g of imidazole, 300 ml of methanol, and 109 g of sodium methylate, and the mixture was stirred to be dissolved. The liquid was heated up to 70° C., and the methanol was distilled off under reduced pressure. When the liquid deposited a solid to become slurry, 450 ml of dimethyl formaldehyde was poured into it, and then the methanol was distilled off again under reduced pressure. After completion of the distillation of the methanol, the reaction mixture was cooled to 35° C., and then 300 g of chloromethyl styrene was added dropwise to it spending 30 minutes, during which the mixture was kept at 35°–40° C. After completion of the dropping, the mixture was stirred for a period of 3 hours, and then the mixture was cooled to room temperature. After that 1 liter of toluene was added to the mixture. The mixture was washed four times with 1 liter of water, and then 1.2 liters of 2N hydrochloric acid were used to extract the resulting monomer into the water phase. The water phase was added dropwise to 2 liters of 1.5N sodium hydroxide solution. The deposited oil phase was extracted by 1.2 liters of dichloromethane. The extracted liquid was washed with water, then dried by use of magnesium sulfate, and then concentrated to thereby obtain an objective product. Yield: 306.4 g (85%), Purity: 78%

SYNTHESIS EXAMPLE 2

Synthesis of Exemplified Polymer 1

Into a 4-kneck flask equipped with a stirrer, cooler, thermometer and nitrogen gas conduction pipe were put 100 g of the monomer that has been obtained in Synthesis Example 1 and 1.25 liters of deaired water, and the mixture was stirred. To this were added 40.0 ml of Trax H-45 (sodium salt of the condensate of an alkyl phenol and ethyleneoxide: a product of Nippon Oils & Fats Co., Ltd.). To this were then added 20.6 g of styrene and 7.8 g of divinyl benzene, ad the mixture was stirred for 30 minutes at room temperature, and then heated. When the temperature came up to 65° C., to the mixture was added dropwise a polymerization initiator solution prepared by dissolving 12 g of potassium hydroxide and 1.8 g of azobiscyano valeric acid into 38 ml of deaerated water, and the mixture was stirred for 3 hours at 65° C. The reaction liquid was cooled to room temperature, and then filtered, whereby 1430 ml of a polymer latex (containing 10% solid)were obtained.

EXAMPLE 1

Exemplified Compounds 1, 2, 4 and 8 were synthesized following the synthesis examples. On the other hand, as comparative compounds the following compounds were synthesized in the manner as described in Japanese Patent O.P.I. Publication Nos. 22766/1980 and 48210/1980.

Comparative Compound (a):

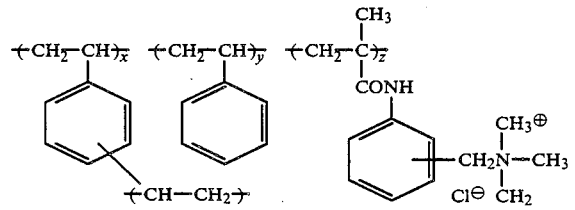

x:y:z = 4:48:48

Comparative Compound (b):

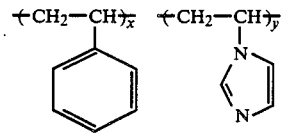

x:y = 50:50

Eight grams of each of Exemplified Compounds 1, 2, 4 and 8 and of Comparative Compounds (a) and (b), 0.98 g of 4-hydroxy-methyl-4-methyl-1-phenyl-3-pyrazolidinone, 8 g of gelatin, 0.6 g of mucochloric acid, and 0.75 ml of a 10% Emulgen-108 (polyoxyethylenenonyl-phenyl ether: a product of Kao Atlas Co., Ltd.) were dissolved into water and finished by adding water to make the whole quantity 250 ml. The resulting liquid was then coated on a 100 μm-thick transparent polyethylene terephthalate support so that the coating quantity of the polymer is 2.7 g/m$^2$, that of 4-hydroxymethyl-4-methyl-1-phenyl-3-pyrazolidinone is 0.33 g/m$^2$, and that of gelatin is 2.7 g/m$^2$. The thus coated layer was regarded as an image-receiving layer (the first layer).

On the first layer as the image-receiving layer comprising each of the exemplified compounds and comparative compounds the following protective layer as the second layer comprised of gelatin (0.65 g/m$^2$) and glyoxal (0.06 g/m$^2$) was coated, whereby Image-Receiving Sheets 1, 2, 4, 8, a and b were obtained.

Subsequently, on a 180 μm-thick transparent polyethylene terephthalate film support the following layers were coated in order, thereby obtaining Light-Sensitive Sheet-1.

The first layer: A color material layer containing the following Magenta Dye Image Forming Compound [I] (0.8 g/m$^2$), diethyl-laurylamide (0.4 g/m$^2$) and gelatin (1.5 g/m$^2$).

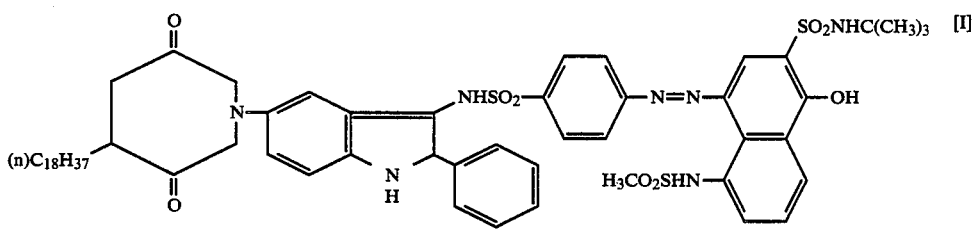

The second layer A: A green-sensitive negative-type silver halide emulsion layer comprised of a green-sensitized negative-type silver halide emulsion (silver coating amount: 0.5 g/m$^2$), potassium 2-octadecyl-hydroquinone-5-sulfonate (0.17 g/m$^2$) and gelatin (1.3 g/m$^2$).

The third layer: A layer containing gelatin (0.94 g/m$^2$).

The above-described light-sensitive sheet was exposed through an optical wedge having different density steps to light.

The exposed sheet was immersed for 20 seconds in an activator solution having the following composition at 23° C., and then the sheet was superposed on each of Image-Receiving Sheets 1, 2, 4, 8, a and b, and each of the superposed pairs was passed between a juxtaposed pair of pressure rollers.

Activator composition:

| | |
|---|---|
| Potassium hydroxide | 56.2 g |
| 5-methyl-benzotriazole | 7.2 g |
| 11-aminoundecandic acid | 2.0 g |
| Potassium bromide | 2.0 g |
| Water to make 1,000 cc. | |

Two minutes later, the light-sensitive sheet and image-receiving sheet were peeled apart. The image-receiving sheet was neutralized with an aqueous acetic acid solution, and after that the reflective density of the sheet was measured through a green filter by use of a photoelectric densitometer (SAKURA Photoelectric Densitometer PDA-60, manufactured by Konishiroku Photo Industry Co., Ltd.).

After the peeling, each of the test pieces, as a light-stability test sample, was partly masked with black paper to intercept light, and the remainder was exposed. The thus prepared sample was exposed over a period of 72 hours to light arranged so that the sample's surface illuminance is 60,000 luxes.

The masked area's density close to 1.0 was regarded as Dm, and the non-masked area's density was regarded as D, and the D/Dm×100(%) (ΔD) was found, then the following results were obtained:

TABLE 1

| Photographic element* | | Dm | ΔD |
|---|---|---|---|
| (Invention) | 1-1 | 1.96 | 80% |
| | 2-1 | 1.90 | 79% |
| | 4-1 | 1.98 | 81% |
| | 8-1 | 1.88 | 78% |
| (Comparative) | a-1 | 1.88 | 46% |
| | b-1 | 1.62 | 77% |

Note: *For example, the "8-1" means the combination of Image-Receiving Sheet 8 with Light-Sensitive Sheet 1. The same shall apply to the other elements.

The above results show that the imidazole radical-containing mordant has excellent characteristics to the dye's stability to light as compared to the quaternary-salt mordant, and the imidazole copolymers of the present invention are excellent in the coatability, allows no change in the mordanting power by a hardening agent, etc., excellent in the mordanting ability as well as in the image stability.

EXAMPLE 2

On a 180 μm-thick transparent poly(ethylene terephthalate) film support the following layers were coated in order, whereby Light-Sensitive Sheet 2 was prepared.

(1) Neutralizing layer:

A neutralizing layer formed by coating in the extrusion process a methanol solution containing 100 parts by weight of poly(n-butylacrylate-co-acrylic acid) (ratio by weight: 30:70) and 2 parts by weight of a silane-coupling agent as a hardener (produced by Toray Silicon Co., Ltd.) so that the coating quantity of the polymer is 10 g/m$^2$.

(2) Timing layer:

A timing layer formed by coating in the extrusion process an acetone solution of a mixture of 95 parts by weight of a lactone polymer, as in Japanese Patent O.P.I. Publication No. 54341/1980, whose acid/butyl ester ratio is 15:85, the acid/butyl ester compound being prepared in the manner that vinyl acetate-maleic anhydride copolymer is hydrolyzed and lactonized, and then partially esterified by n-butanol, and 5 parts by weight of poly(vinylidene chloride-co-acrylic acid-co-methyl acrylate) (ratio by weight: 65:30:5), the said coating being made so that the coating amount of the polymer is 3.0 g/m$^2$.

(3) Cyan color material layer:

A cyan color material layer comprised of gelatin (1.6 g/m$^2$), tricresyl phosphate (0.32 g/m$^2$) and a cyan color image forming material (0.64 g/m$^2$) having the formula:

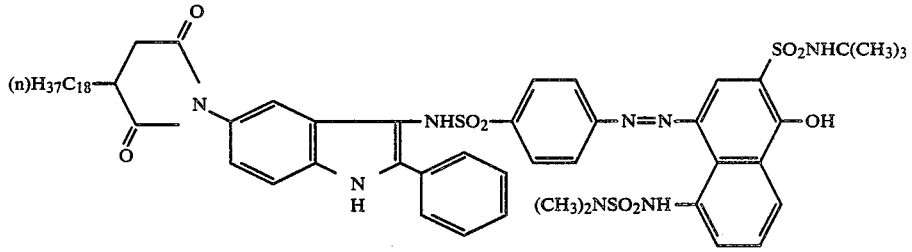

(4) Red-sensitive negative-type silver halide emulsion layer:

A red-sensitive negative-type silver halide emulsion layer comprised of a red-sensitized negative-type silver halide emulsion (silver coating amount: 0.35 g/m$^2$), potassium 2-sec-octadecyl-hydroquinone-5-sulfonate (0.17 g/m$^2$) and gelatin (1.5 g/m$^2$).

(5) Interlayer:

A layer comprised of gelatin (0.63 g/m$^2$) and 2-acetyl-5-sec-octadecyl-hydroquinone (0.45 g/m$^2$).

(6) Magenta color material layer comprised of gelatin (1.5 g/m$^2$), diethyl-laurylamide (0.4 g/m$^2$) and a magenta color image forming material (0.8 g/m$^2$) having the formula:

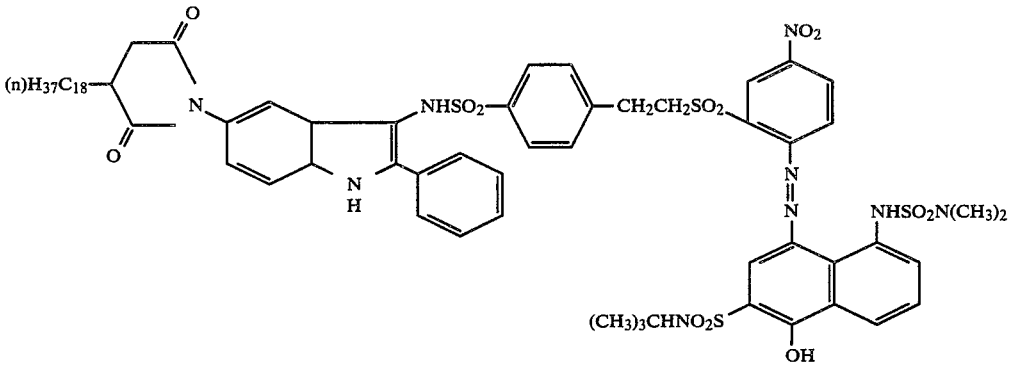

(7) Green-sensitive negative-type silver halide emulsion layer:

A green-sensitive negative-type silver halide emulsion layer comprised of a green-sensitized negative-type silver halide emulsion (silver coating amount: 0.5 g/m$^2$), potassium 2-octadecyl-hydroquinone-5-sulfonate (0.17 g/m$^2$) and gelatin (1,3 g/m$^2$).

(8) Interlayer:

An interlayer comprised of gelatin (0.63 g/m$^2$) and 2-acetyl-5-sec-octadecyl-hydroquinone (0.45 g/m$^2$).

(9) Yellow color material layer:

An yellow color material layer comprised of gelatin (1.2 g g/m$^2$), tricresyl phosphate (0.25 g/m$^2$) and an yellow color image forming material (0.56 g/m$^2$) having the formula:

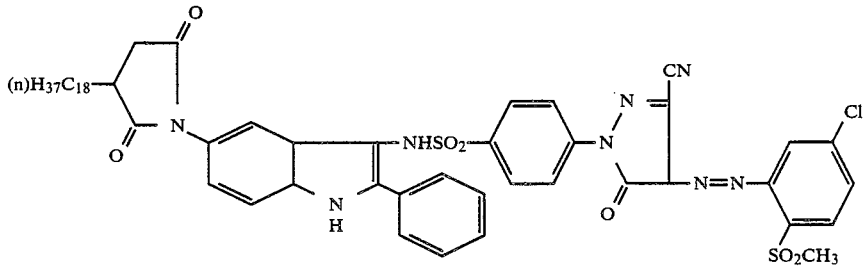

(10) Blue-sensitive negative-type silver halide emulsion layer:

A blue-sensitive negative-type silver halide emulsion layer comprised of a blue-sensitized negative-type silver halide emulsion (silver coating amount: 0.55 g/m$^2$), potassium 2-octadecyl-hydroquinone-5-sulfonate (0.17 g/m$^2$) and gelatin (1.3 g/m$^2$).

(11) Protective layer:

A protective layer comprised of gelatin (0.8 g/m$^2$), methacrylate beads having a diameter of from 2 to 4 μm (0,15 g/m$^2$), silica having a particle size of 0.2 μm (0.45 g/m$^2$) and tetrakis(vinyl-sulfonyl methyl)methane (0.2 g/m$^2$).

The foregoing Light-Sensitive Sheet 2 was exposed to light through an optical wedge having different density steps.

The exposed Light-Sensitive Sheet 2 was processed and then superposed on each of Image-Receiving Sheets 1, 2, 4, 8, a and b of Example 1 in the same manner as previously described. Five minutes layer, the light-sensitive sheet and image-receiving sheet were peeled apart, and then the reflective density of the image-receiving sheet was measured through a red filter (λmax=644 nm), a green filter (λmax=546 nm) and a blue filter (λmax=434 nm) with use of a photoelectric densitometer (SAKURA Photoelectric Densitometer PDA-60, manufactured by Konishiroku Photo Industry Co., Ltd.), whereby the following results were obtained.

TABLE 2

| Photographic element* | | B Dmax | B Dmin | G Dmax | G Dmin | R Dmax | R Dmin |
|---|---|---|---|---|---|---|---|
| (Invention) | 1-2 | 1.88 | 0.08 | 1.94 | 0.06 | 2.25 | 0.06 |
| | 2-2 | 1.78 | 0.07 | 1.86 | 0.05 | 2.05 | 0.06 |
| | 4-2 | 1.90 | 0.09 | 2.00 | 0.07 | 2.16 | 0.06 |
| | 8-2 | 1.82 | 0.09 | 1.83 | 0.06 | 2.03 | 0.06 |
| (Comparative) | a-2 | 1.80 | 0.10 | 2.02 | 0.07 | 1.92 | 0.06 |
| | b-2 | 1.68 | 0.08 | 1.72 | 0.05 | 2.02 | 0.06 |

Note:
*For example, the "8-2" means the combination of Image-Receiving Sheet 8 with Light-Sensitive Sheet 2. The same shall apply to the other elements.

Further, the stability of each image-receiving sheet was tested in the same manner as in Example 1.

TABLE 3

| Photographic element* | | ΔD B | ΔD G | ΔD R |
|---|---|---|---|---|
| (Invention) | 1-2 | 94 | 83 | 80 |
| | 2-2 | 95 | 78 | 77 |
| | 4-2 | 95 | 85 | 82 |
| | 8-2 | 94 | 76 | 78 |
| (Comparative) | a-2 | 84 | 56 | 72 |
| | b-2 | 94 | 76 | 74 |

As is apparent from Tables 2 and 3, by using the photographic element of the present invention, photographic materials in the color diffusion transfer process can generally have a high mordanting ability, high Dmax, excellent color image preservability, and excellent stability to light of colors.

EXAMPLE 3

In the multicolor Light-Sensitive Sheet 2 in Example 2, the fourth, seventh and tenth layers, the silver halide emulsion layers, were replaced by the following silver halide emulsion layers, thus preparing a multicolor Light-Sensitive Sheet 3.

(4) Red-sensitive silver halide emulsion layer comprised of a red-sensitive internal latent image-type direct positive silver bromide emulsion (silver coating amount: 1.0 g/m$^2$), potassium 2-sec-octadecyl-hydroquinone-5-sulfonate (0.17 g/m$^2$), the following nucleating agent (1.2 mg per mole of silver) and gelatin (1.5 g/m$^2$).

(7) Green-sensitive silver halide emulsion layer comprised of a green-sensitive internal latent image-type silver bromide emulsion (silver coating amount: 0.8 g/m$^2$), potassium 2-octadecyl-hydroquinone-5-sulfonate (0.17 g/m$^2$), the following nucleating agent (1.2 mg per mole of silver) and gelatin (1.3 g/m$^2$).

(10) Blue-sensitive silver halide emulsion layer comprised of a blue-sensitive internal latent image-type silver bromide emulsion (silver coating amount: 0.8 g/m$^2$), potassium 2-octadecyl-hydroquinone-5-sulfonate (0.17 g/m$^2$), the following nucleating agent (1.2 mg per mole of silver) and gelatin (1.3 g/m$^2$).

The nucleating agent to be used in the above has the formula:

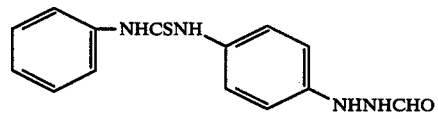

Light-Sensitive Sheet 3 that has been obtained in the above was exposed to light through an optical wedge having different density steps, and then superposed on each of the image-receiving sheets of Example 1 to be processed in an alkaline processing solution in the same manner as in the previous examples. Ten minutes later, the light-sensitive sheet and image-receiving sheet were peeled apart, and then the reflective density of the image-receiving sheet was measured through a red filter (λmax=644 nm), a green filter (λmax=546 nm) and a blue filter (λmax=434 nm) with use of a photoelectric densitometer (SAKURA Photoelectric Densitometer PDA-60, manufactured by Konishiroku Photo Industry Co., Ltd.). The obtained results are as follows:

TABLE 4

| Photographic element | | B Dmax | B Dmin | G Dmax | G Dmin | R Dmax | R Dmin |
|---|---|---|---|---|---|---|---|
| (Invention) | 1-3 | 1.78 | 0.17 | 1.86 | 0.19 | 2.02 | 0.13 |
| | 2-3 | 1.76 | 0.16 | 1.85 | 0.18 | 1.86 | 0.13 |
| | 4-3 | 1.80 | 0.19 | 1.88 | 0.20 | 2.06 | 0.16 |

TABLE 4-continued

| Photographic element | | B Dmax | B Dmin | G Dmax | G Dmin | R Dmax | R Dmin |
|---|---|---|---|---|---|---|---|
| | 6-3 | 1.76 | 0.17 | 1.84 | 0.17 | 1.84 | 0.13 |
| (Comparative) | a-3 | 1.75 | 0.20 | 1.86 | 0.23 | 1.77 | 0.17 |
| | b-3 | 1.63 | 0.17 | 1.65 | 0.18 | 1.83 | 0.13 |

As is obvious from Table 4, the image-receiving sheet containing the polymer of the present invention is excellent in the mordanting ability and, even when the direct positive-type emulsion is used, shows a satisfactory image.

SYNTHESIS EXAMPLE 3

Synthesis of an intermediate latex[poly(divinylbenzene-co-styrene-co-N,N-dimethylaminomethylmethacrylamide-co-N-vinylbenzylimidazole)]

300 milliliters of distilled water were put in a 500-ml flask equipped with a stirrer, reflux condenser, thermometer and nitrogen gas conduction pipe, and the water was refluxed for 30 minutes under the atmosphere of a nitrogen gas, and then cooled to 40° C. under a nitrogen gas flow. To this were added 8.9 g of N-vinylbenzylimidazole, 25.2 g of N,N-dimethylaminomethylmethacrylamide, 7.0 g of styrene, 2.3 g of divinylbenzene, and 10.0 ml of Trax H-45 (sodium salt of the condensate of an alkylphenol and ethyleneoxide, a product of Nippon Oils & Fats Co., Ltd.), and the mixture was stirred at a rate of 300 rpm., and then heated up to 65° C. When the monomers inside the flask were emulsified uniformly, a polymerization initiator prepared by dissolving 0.35 g of potassium hydroxide and 0.55 g of azobiscyanovaleric acid into 12 ml of distilled water was added to the mixture, and the mixture was stirred for three hours at the same temperature. After that, the reaction liquid was cooled to room temperature, and then filtrated by suction, whereby 360 ml of a polymer latex solution (solid: 11.9%) were obtained.

SYNTHESIS EXAMPLE 4

Synthesis of Exemplified Polymer 6

360 milliliters of the intermediate latex that was obtained in the above Synthesis Example 3 were put in a 500-ml flask equipped with a stirrer, reflux condenser, thermometer, and dropping funnel, and the intermediate latex was stirred at a rate of 300 rpm. at room temperature. To this were added dropwise 110 ml of acetonitrile spending an hour, and further added dropwise 14.6 g of benzyl chloride spending 10 minutes. The resulting mixture was stirred for 30 minutes at room temperature, and then heated up to 75° C. and stirred for six hours. The reaction mixture was then cooled to room temperature, and filtrated by suction to obtain a latex liquid. From the latex liquid the acetonitrile was distilled off, and then the latex was stuffed into a dialysis tube to be dialyzed in demineralized water. After completion of the dialysis, the latex liquid was condensed, whereby 1 liter of a latex liquid of Exemplified Polymer 6 (solid: 5.2%, viscosity: 5.9 cps (determined by use of a B-type rotational viscometer)) was obtained.

SYNTHESIS EXAMPLE 5

Synthesis of Exemplified Polymer 15

365 milliliters of a latex solution of Exemplified Polymer 15 (solid: 12.9%) were obtained in the same manner as in Synthesis Example 3 except that the monomers were replaced by the following monomers: 8.9 g of N-vinylbenzylimidazole, 25.0 g of p-methacroylaminobenzyl-benzyl-dimethylammonium chloride, 11.6 g of styrene and 2.3 g of divinylbenzene.

EXAMPLE 4

Exemplified Compounds 15, 20, 27 and 32 were synthesized in the same manner as in the above synthesis examples. On the other hand, as comparative polymers, the following compounds were synthesized in the same manner as described in Japanese Patent O.P.I. Publication No. 22766/1980.

Comparative Compound (a):

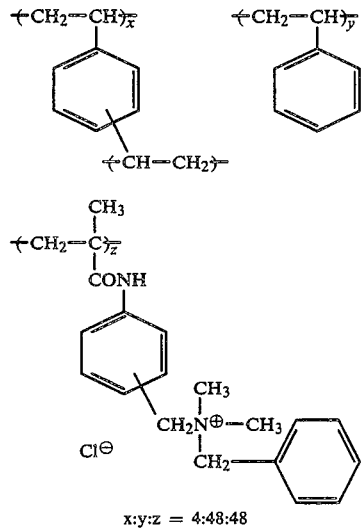

x:y:z = 4:48:48

Comparative Compound (b):

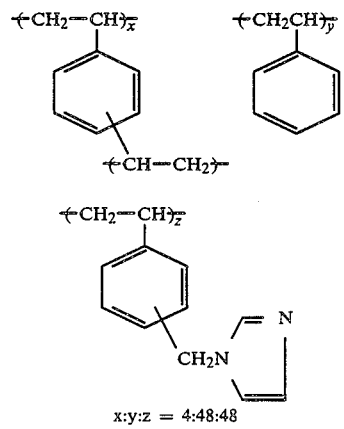

x:y:z = 4:48:48

Eight grams of each of the thus synthesized Exemplified Compounds 15, 20, 27 and 32 and Comparative Compounds a and b, 0.98 g of 4-hydroxymethyl-4-methyl-1-phenyl-3-pyrazolidinone, 8 g of gelatin, 0.6 g of mucochloric acid, and 0.75 g of 10% Emulgen-108 (polyoxyethylenenonyl-phenyl ether, a product of Kao Atlas Co., Ltd.) were dissolved into water and water was added to make the whole quantity 250 ml. The solution was coated on a 100 μm-thick transparent polyethylene terephthalate film support so that the coating amount of the polymer is 2.7 g/m$^2$, and the thus coated layer was regarded as the first layer of each image-receiving sheet.

On the first layer of each image-receiving sheet and each comparative image-receiving sheet was coated the following second layer, and the thus completed sheets were regarded as Image-Receiving Sheets 15, 20, 27, 32, a and b.

The second layer: A protective layer comprised of gelatin (0.65 g/m$^2$) and glyoxal (0.06 g/m$^2$).

On the other hand, on a 180 μm-thick transparent polyethylene terephthalate film support the following layers were coated in order, whereby Light-Sensitive Sheet 4 was prepared.

(1 ) A layer comprised of gelatin (1.5 g/m$^2$), diethylaurylamide (0.4 g/m$^2$), and a magenta dye forming compound (0.8 g/m$^2$) having the Formula [I]:

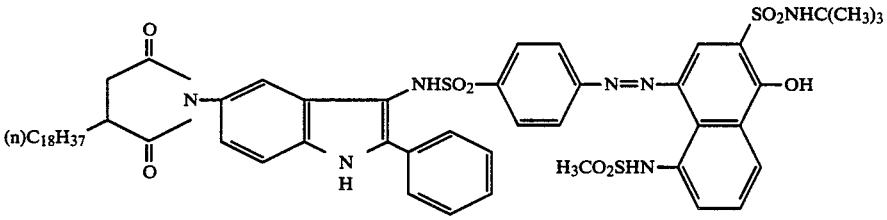

(2) A green-sensitive silver halide emulsion layer comprised of a green-sensitive negative-type silver halide emulsion (silver coating amount: 0.5 g/m$^2$), potassium 2-octadecyl-hydroquinone-5-sulfonate (0.17 g/m$^2$) and gelatin (1.3 g/m$^2$).

(3) A gelatin layer (0.94 g/m$^2$)

Light-Sensitive Sheet 4 was exposed to light through an optical wedge having different density steps. The exposed sheet was immersed for 20 seconds at 23° C. in an activator solution having the same composition as was used in Example 1 in a shallow tray-type processor, and then superposed on each of the foregoing image-receiving sheets. The superposed pair was passed between a pair of juxtaposed pressure rollers.

After a specified time has passed, the light-sensitive sheet and image-receiving sheet were peeled apart. After being neutralized by an aqueous acetic acid solution, the image-receiving sheet was measured with respect to its reflective densities. The measurements were made through a green filter sequentially at time intervals by use of a SAKURA Photoelectric Densitometer PDA-60 (manufactured by Konishiroku Photo Industry Co., Ltd.). The obtained results are as shown in Table 5.

TABLE 5

| Photographic element* | | $D_2$ | $D_5$ | $D_2/D_5$ | ΔD |
|---|---|---|---|---|---|
| (Invention) | 15-4 | 1.90 | 2.07 | 92 | 81 |
| | 20-4 | 2.12 | 2.14 | 99 | 83 |
| | 27-4 | 2.07 | 2.11 | 98 | 77 |
| | 32-4 | 1.84 | 2.02 | 91 | 76 |
| (Comparative) | a-4 | 1.88 | 2.09 | 90 | 46 |

TABLE 5-continued

| Photographic element* | | $D_2$ | $D_5$ | $D_2/D_5$ | ΔD |
|---|---|---|---|---|---|
| | b-4 | 1.62 | 1.82 | 89 | 76 |

Note: *In Table 5, for example, the "15-14"means the combination of Image Receiving Sheet 15 and Light-Sensitive Sheet 4. The same shall apply to the other elements.

In Table 5, $D_2$ and $D_5$ represent the maximum transfer densities in the 2-minute processing and 5-minute processing, respectively, and $D_2/D_5$ is the ratio between the maximum densities in the 2-minute and 5-minute processings, which will be a criterion for the color image forming rate.

A satisfactory mordant is an agent that has a strong mordanting ability, a more rapid color image forming rate, and allows no movement of dyes such as the attaching or detaching thereof.

It is understood that any of the polymers of the present invention has a high mordanting ability, a satisfactory color image forming rate, and causes no attaching or detaching of dyes as compared to the comparative polymers.

After the processing, each of the test pieces (the image-receiving sheets) was partially masked by black paper with its remainder half exposed, and subjected to a light-resistance test by placing the piece over a period of four days under the light-discolorating conditions of 50,000 luxes (on the surface) at a temperature of 35° C. with a relative humidity of 53%. $D/Dm \times 100\% = \Delta D$ (wherein Dm is the masked area's density close to 1.0 obtained in the above conditions, and D is the density of the non-masked area) was found, and the obtained results are as given in Table 5.

The above results show that the imidazole group-containing mordant makes a great contribution to the stability of dyes against light as compared to the quaternary-salt mordant, and the copolymer of the quaternary salt and imidazole of the present invention has both excellent light-stability of the imidazole group and high mordanting ability of the quaternary salt.

EXAMPLE 5

In the same manner as in Example 4, Image-Receiving Sheets 15 and 20 having image-receiving layers containing Exemplified Compounds 15 and 20, respectively, were prepared.

On the other hand, as comparative compounds, the Comparative Polymers (a) and (b) of Example 4 were used. Using these comparative polymers, Image-Receiving Sheets A and B were prepared, which each has a comparative image-receiving layer containing Comparative Polymers (a) and (b) that were mixed so that the coating quantities of the quaternary-salt unit and imidazole unit are the same as those of Exemplified Compounds 15 and 20. Under this condition, the mixed proportion by weight of Comparative Compound (a) to Comparative Compound (b) are as follows:

| | Comparative Compound (a) | Comparative Compound (b) |
|---|---|---|
| Comparative Image Receiving Layer A | 2.3 | 1 |
| Comparative Image Receiving Layer B | 3.7 | 1 |

Using the light-sensitive sheet of Example 4, each of the thus prepared image-receiving sheets was processed in the same manner as in Example 4 to examine the mordanting ability and the resistance to light. The results are as given in Table 6, wherein the symbols are as defined in Example 4.

TABLE 6

| Photographic element | | $D_2$ | D |
|---|---|---|---|
| (Invention) | 15-4 | 1.88 | 78 |
| | 20-4 | 2.03 | 81 |
| (Comparative) | A-4 | 1.85 | 43 |
| | B-4 | 1.86 | 43 |

As is apparent from Table 6, whereas these comparative image-receiving layers, although they have a high mordanting ability, are poor in the stability to light, the polymers of the present invention are excellent in the stability to light as well as in the mordanting ability.

Thus, the objects of the present invention have been sufficiently accomplished. The present invention provides satisfactory characteristics required for the image-receiving layer in the color diffusion transfer process, and has developed a new field of mordants to be also suitably applicable as scavenger.

What is claimed is:

1. A photographic element used in a color diffusion transfer process comprising an image receiving layer containing a polymer having monomer units represented by Formula I

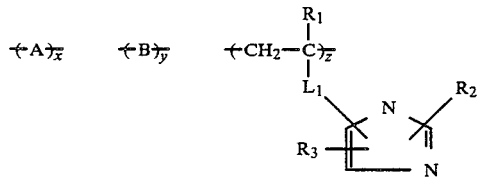

I wherein A is a copolymerizable monomer unit having at least two ethylenically unsaturated groups; B is a copolymerizable $\alpha,\beta$ ethylenically unsaturated monomer unit; $R_1$ is hydrogen or methyl; $R_2$ and $R_3$ are independently hydrogen, alkyl, or aryl; $L_1$ is a divalent combining group and $0.5 \leqq x \leqq 6.0$, $0 \leqq y \leqq 79.5$, and $20 \leqq z \leqq 99.5$, wherein the values of x, y, and z are expressed as copolymerization mole percentages.

2. A photographic element used in a color diffusion transfer process comprising an image receiving layer containing a polymer having monomer units represented by Formula II

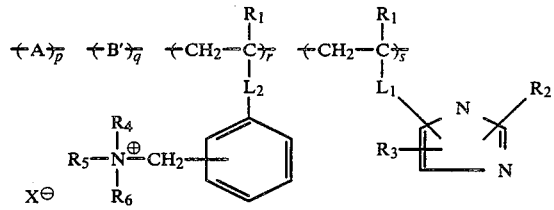

II wherein A is a copolymerizable monomer unit having at least two ethylenically unsaturated groups; B' is a copolymerizable $\alpha,\beta$-ethylenically unsaturated monomer unit; $R_1$ is hydrogen or methyl; $R_2$ and $R_3$ are independently hydrogen, alkyl, or aryl; $R_4$, $R_5$ and $R_6$ are independently alkyl groups; $L_1$ and $L_2$ are independently divalent combining groups; X is a monovalent anion; and $6.0 \geqq p \geqq 0$, $80 \geqq q \geqq 0$, $90 \geqq r \geqq 10$, and $90 \geqq s \geqq 10$, wherein the values of p, q, r, and s are copolymerization mole percentages.

3. The photographic element comprising a layer containing a polymer having monomer units represented by Formula (II)

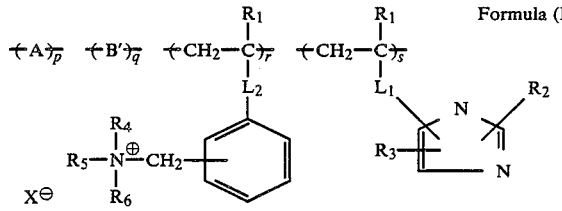

Formula (II)

wherein A is a copolymerizable monomer unit having at least two ethylenically unsaturated groups; B' is a copolymerizable $\alpha,\beta$-ethylenically unsaturated monomer unit; $R_1$ is a hydrogen atom or a methyl group; $R_2$ and $R_3$ are independently a hydrogen atom, an alkyl or aryl group; $R_4$, $R_5$ and $R_6$ are independently an alkyl group; $L_1$ and $L_2$ are independently a divalent combining group; X is a monovalent anion; and p, q, r and s are in the ranges of $6.0 \geqq p \geqq 0$, $80 \geqq q \geqq 0$, $90 \geqq r \geqq 10$, and $90 \geqq s \geqq 10$, respectively, which are copolymerization mole percentages.

4. The photographic element of claim 1 wherein said $R_2$ and $R_3$ are independently an alkyl group having from 1 to 4 carbon atoms.

5. The photographic element of claim 1, wherein said $R_2$ and $R_3$ are independently an alkyl group having an aryl group as a substituent, whose total number of carbon atoms is in the range of from 6 to 12.

6. The photographic element of claim 2, wherein said combining group represented by $L_2$ is selected from the group consisting of acid amido group and ester group.

7. The photographic element of claim 1, wherein said copolymerizable monomer unit having at least two ethylenically unsaturated groups represented by A is a monomer represented by Formula (III):

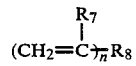

Formula (III)

wherein $R_7$ is a hydrogen atom or a methyl group; $R_8$ is a combining radical having n number of bonding groups; and n is an integer of not less than 2.

8. The photographic element of claim 1, wherein said copolymerizable $\alpha,\beta$-ethylenically unsaturated monomer represented by B or B′ is selected from the group consisting of styrene, and ethylenically unsaturated monocarboxylic acid ester.

9. The photographic element of claim 1, wherein said z is in the range of $25 \leqq z \leqq 70$.

10. The photographic element of claim 2, wherein said r and s are in the ranges of $25 \leqq r \leqq 70$, and $25 \leqq s \leqq 70$, respectively.

11. The photographic element of claim 1, wherein said polymer has a molecular weight of from about 10,000 to about 500,000.

12. The photographic element of claim 1, wherein said polymer is contained in a percentage by weight of from 10 to 100 in said image-receiving layer.

13. The photographic element of claim 12, wherein said image-receiving layer has a coated thickness of from 3 to 10 $\mu$m.

14. The photographic element of claim 2, wherein said $R_2$ and $R_3$ are independently an alkyl group having from 1 to 4 carbon atoms.

15. The photographic element of claim 2, wherein said $R_2$ and $R_3$ are independently an alkyl group having an aryl group as a substituent, whose total number of carbon atoms is in the range of from 6 to 12.

16. The photographic element of claim 2, wherein said copolymerizable monomer unit having at least two ethylenically unsaturated groups represented by A is a monomer represented by Formula III $$(CH_2{=}\overset{\overset{R_7}{|}}{C})_n R_8 \qquad \text{Formula III}$$

wherein $R_7$ is a hydrogen atom or a methyl group; $R_8$ is a combining radical having n number of bonding groups; and n is an integer of not less than 2.

17. The photographic element of claim 2, wherein said copolymerizable $\alpha,\beta$-ethylenically unsaturated monomer represented by B or B′ is selected from the group consisting of styrene and ethylenically unsaturated monocarboxylic acid ester.

18. The photographic element of claim 2, wherein said polymer has a molecular weight of from about 10,000 to about 500,000.

19. The photographic element of claim 1 wherein said $L_1$ has a portion $-l_1-$ selected from the group consisting of phenylene, carbonylamino, and carbonyloxy.

20. The photographic element of claim 1 wherein said $L_1$ has a portion $l_2$ selected from alkylene.

21. The photographic element of claim 1 wherein $L_1$ is $-l_1-l_2-$ wherein $l_1$ is selected from phenylene, carbonylamino, and carbonyloxy; and $l_2$ is selected from alkylenes.

22. The photographic element of claim 21 wherein $l_2$ is bound to the first position of imidazole ring.

23. The photographic element of claim 2 wherein said $L_1$ has as a part thereof $l_1$ selected from the group consisting of phenylene, carbonylamino, and carbonyloxy.

24. The photographic element of claim 2 wherein said $L_1$ has a portion $l_2$ selected from alkylene.

25. The photographic element of claim 2 wherein said $L_1$ is $-l_1-l_2$ wherein $l_1$ is selected from phenylene, carbonylamino, and carbonyloxy; and $l_2$ is selected from alkylene.

26. The photographic element of claim 24 wherein said $l_2$ is bonded to the first position of the imidazole ring.

* * * * *